US006176356B1

(12) United States Patent
Powley

(10) Patent No.: US 6,176,356 B1
(45) Date of Patent: Jan. 23, 2001

(54) DIAPER CHANGING ARTICLE

(76) Inventor: Mary Jo Powley, 5541 Rte. 125, Campbell, NY (US) 14821

( * ) Notice: Under 35 U.S.C. 154(b), the term of this patent shall be extended for 0 days.

(21) Appl. No.: 09/306,794

(22) Filed: May 7, 1999

(51) Int. Cl.[7] ..... A45C 9/00
(52) U.S. Cl. ..... 190/1; 190/2; 383/4
(58) Field of Search ..... 190/1, 2; 383/4; 209/581

(56) References Cited

U.S. PATENT DOCUMENTS

| | | | | |
|---|---|---|---|---|
| 2,970,630 | * | 2/1961 | Larsen et al. | 383/72 X |
| 3,489,194 | | 1/1970 | Hoover | 383/4 |
| 4,156,446 | | 5/1979 | Nathan | 383/103 X |
| 4,337,812 | * | 7/1982 | Trinkner | 383/4 |
| 4,566,130 | * | 1/1986 | Coates | 190/1 X |
| 4,606,087 | | 8/1986 | Alivizatos | 190/2 X |
| 4,789,247 | * | 12/1988 | Schnoor | 190/2 X |
| 4,863,003 | * | 9/1989 | Carter | 383/4 X |
| 4,886,150 | | 12/1989 | Fitzsimmons | 190/1 |
| 4,999,863 | * | 3/1991 | Kane | 190/2 X |
| 5,035,013 | * | 7/1991 | Bloom | 190/2 X |
| 5,187,823 | * | 2/1993 | Ferguson et al. | 383/4 X |
| 5,215,172 | * | 6/1993 | Stevenson | 190/2 |
| 5,482,374 | * | 1/1996 | Buhyoff | 383/4 |
| 5,743,649 | * | 4/1998 | Gonzalez | 383/4 X |
| 5,819,343 | * | 10/1998 | Zampirri, Jr. et al. | 383/4 X |
| 5,895,118 | * | 4/1999 | Hensley | 383/4 X |

FOREIGN PATENT DOCUMENTS

| | | | | |
|---|---|---|---|---|
| 578247 | * | 1/1994 | (EP) | 383/4 |
| 2054388 | * | 2/1981 | (GB) | 190/1 |
| 2220407 | * | 1/1990 | (GB) | 190/2 |

* cited by examiner

*Primary Examiner*—Sue A. Weaver
(74) *Attorney, Agent, or Firm*—Salzman & Levy

(57) ABSTRACT

A handy tote bag for carrying baby items needed to diaper an infant at a remote location. The tote bag has an inner liner that contains a number of pockets for receiving a plurality of items needed to diaper the infant. The pockets are situated about a relatively large central portion that contains a resting space for safely and sanitarily depositing a moist baby, who remains in sight of the care-giver, while the care-giver extracts from the pockets the needed materials and items for diapering the baby and actually changes the baby's diaper.

4 Claims, 2 Drawing Sheets

DIAPER CHANGING ARTICLE

FIELD OF THE INVENTION

The invention relates to a diaper bag-like device for changing moist infants and, more particularly, to an article of manufacture that provides all of the accoutrements for protecting the infant from unsanitary environments, cleaning and making comfortable a baby requiring diapering at remote public locations which may include potential health risks.

BACKGROUND OF THE INVENTION

In the busy world of today, parents, grandparents and babysitters struggle to change their babies, while at work, while shopping, while traveling, while at play, and while engaged in athletic activities common to this hectic, modern era.

The caregiver presently uses a large tote bag for storing the many items needed to diaper and make comfortable the infant. The tote bag is often clumsy and inefficient. The presently used totes offer no consideration of or protection from potential health risks. Items like diapers and wipes needed to change the baby at remote locations, are intermixed with car keys, pens, tissues, wallets and other personal articles of the adult. These items, alone, can contribute to the health risks of the infant.

After struggling to locate all of the needed items during a diaper change, the parent is also faced with the problem of where to place a smelly baby. Placing a moist baby on a blanket or car seat is not very efficient. In a work place or at an athletic event, finding a convenient table, bench or space to position the baby for a diaper change is often discovered to be a scarce commodity, and very unsanitary, at best.

It is often difficult and inconvenient to find the immediate item needed, when searching and rummaging through a sea of extraneous articles in presently designed tote bags.

The present invention seeks to provide a tote bag or carrying article that organizes all of the needed baby items into easily located compartments or pockets for effortless access. The invention provides a safe, protected environment which is healthy and infection free. The invention also provides a space in which the baby itself can safely rest while the parent locates the diapering needs and attends to the diaper changing operation. The infant never comes into contact with foreign germs left behind by other infants. The sides of the article offer environmental (wind/sun) protection to the baby. In this way, the baby can be cared for (e.g., fed, changed, washed, dressed, entertained, etc.).

The compartments holding the diaper items are disposed inside of the tote bag. The liner of the tote bag comprises a layer of flexible, tough material. A draw string runs through the liner along a peripheral edge thereof. After the articles have been placed in their individual pockets, the draw string is pulled and the bag is ready to move to a remote location.

The compartments are individually shaped and sized to accommodate a particular baby item. Each compartment is stitched or thermally welded into the inner bag lining. Each compartment is designed to hold a specific item needed by the parent or adult custodian. For example, baby bottles are contained within an elongated pocket that is both waterproof and thermally insulated. Wallets and car keys are disposed in rectangular compartments as befits their shape and size. Moreover, such non-baby items could also be easily accessed from the outside of the closed bag.

All of the compartments have a transparent, plastic window so that each stored article is easily observable and recognized at a glance. The plastic window can form at least a portion of the pocket when the bag is deployed (opened). The bag contains compartments for other items, such as diapers, powder, lotion, toys, cleansing fabrics, towelettes and baby clothing.

The tote bag of this invention easily opens into an area, wherein all of the items needed by the infant caregiver present themselves to a presentation view. The circumference of the bag can be rigid to form a bowl-shaped structure to protect the infant from wind and to prevent pocket contents from spilling or rolling out. All of the pockets are circumferentially disposed about a center portion of the bag interior. The center portion is designed as a sanitary, safe, viewable resting place for baby during changing, and while the parent is busy extracting the needed items for diapering. The center portion is padded to provide comfort for the baby, and lined with a replaceable layer of vinyl to provide a waterproof surface. The center portion is provided with a built-in pillow.

DISCUSSION OF RELATED ART

In U.S. Pat. No. 4,886,150, issued to Julie-Anna FITZSIMMONS on Dec. 12, 1989, and entitled BABY ACCESSORY CARRIER, a tote bag for carrying articles is shown. The tote has an inner, impermeable liner for protecting against extraneous fluids, but lacks insulated pockets for baby bottles and individual pockets for housing only one specific item per pocket. Nor does the article provide a resting place for baby during the diapering phase. The subject article does not locate all of the pockets in a circular fashion about the rest pad. The tote does not provide see-through compartments where items are easily observed and viewable.

In U.S. Pat. No. 3,489,194, issued to D. H. HOOVER on Jan. 3, 1970, and entitled DIAPER CHANGER BAG, one pouch is shown having several undistinguished pockets. Any one of these pockets can contain a variety of items such as baby powder, baby bottles, soiled diapers, etc. There appears to be no distinguishing difference between any of these compartments, with the exception of a separate pouch for soiled diapers. None of the pockets is designed to be adjacent the rest area of the baby. In fact, HOOVER does not teach a rest area for the baby.

In U.S. Pat. No. 4,606,087, issued to Margaret A. ALIVIZATOS on Aug. 19, 1986, and entitled CONVERTIBLE BODY SUPPORTING PADS, pads or mattresses are shown independent of a tote bag. ALIVIZATOS does not teach that a pillow can be folded away for ease of carrying within a tote bag, and either removed or flipped upwardly to accommodate larger children.

In U.S. Pat. No. 4,156,446, issued to Ludwig NATHAN on May 29, 1979, and entitled TOTE BAG, a tote bag is disclosed for carrying snorkeling equipment. Although NATHAN teaches transparent panels, he does not teach that one can distinguish a particular baby bottle from a can of baby powder, for example, by the use of such panels.

SUMMARY OF THE INVENTION

In accordance with the present invention, there is provided a tote bag for carrying items needed to diaper a baby at remote locations. The lining of the tote bag comprises a layer of flexible, tough material. A draw string runs through the liner material, along a peripheral edge thereof, in order to draw the liner into a closed tote bag configuration. The inner section of the lining comprises a plurality of pockets or compartments layed out in a pattern. The pockets are specifically designed to hold individual baby items, such as diapers, powder, lotion, toys, cleansing cloths, towelettes, baby clothing and caregiver's belongings; e.g., keys, money, etc. The compartments are individually shaped and sized to accommodate the particular baby or parental item. Each compartment is stitched or thermally welded into the inner bag lining. Specific elongated pockets can hold warm baby bottles. These elongated pockets are both waterproof and thermally insulated. Wallets and car keys are disposed in rectangular compartments as befits their shape and size. All of the compartments have a transparent, plastic window so that each stored article is easily observable and recognized at a glance. The plastic windows can form at least a portion of the pockets. The tote bag easily opens into a substantially flat or bowl-shaped panoply of articles, wherein all of the items needed by the caregiver present themselves in a panoramic display view. The pockets are circumferentially disposed about a center portion of the bag interior. The center portion serves as a resting place for the baby during changing, and while the parent is busy extracting the needed items for diapering. The center portion is provided with a soft pad for the baby. The pad can be disposed within a liner of vinyl to provide a waterproof surface. The center pad can be scented and made for removal from the liner for periodic changing. The center portion can also be provided with a built-in pillow. The outer surface of the tote bag liner can comprise hooks, which can be relatively soft, safety devices, for attaching carrying straps to the bag.

It is an object of the invention to provide an environmentally sound and substantially germ-free condition to care for and diaper a baby when such environment may not be accessible.

It is an object of the invention to provide an improved, machine washable and dryable tote bag for carrying baby items needed to care for and diaper a baby, such baby items being in a protected, clean and healthy environment.

It is another object of this invention to provide a tote bag for diapering a baby at a remote location, which may itself be unsanitary and unprotected.

It is a further object of the invention to provide a convenient tote bag containing baby diapering items that are easily located and accessed therein.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components will bear the same designation and numbering throughout the figures.

DESCRIPTION OF THE PREFERRED EMBODIMENT

Generally speaking, the invention features a handy tote bag for carrying baby items needed to diaper an infant at a remote location. The tote bag has an inner liner that contains a number of pockets for receiving a plurality of items needed to diaper the infant. The pockets are situated about a central portion that contains a resting space for depositing a moist baby while the parent extracts from the pockets, the needed materials and items for diapering the moist baby.

Figure 1:
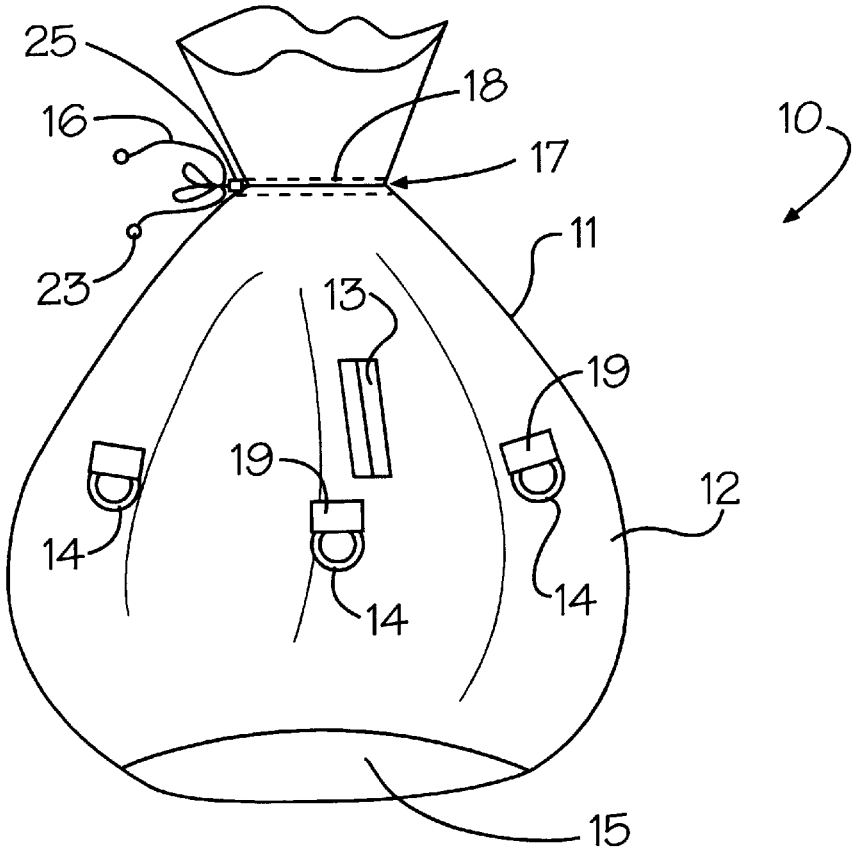
FIG. 1 illustrates a perspective view of the tote bag of this invention in a closed position.

Now referring to FIG. 1, the tote bag 10 of this invention is shown in a closed position. The tote bag 10 comprises a flexible material 11 such as leather, vinyl, cloth, etc. A number of metal rings 14 are attached to an outer liner 12 of the tote bag 10. The rings 14 can be sewn, glued or riveted to the liner 12 with attachment strips 19 as is appropriate for the material.

A draw string 16 is disposed about the neck portion 17 of the bag 10. The draw string 16 can be captured in an inner hollow passage 18 of the bag 10, created by the attachment of an inner liner 27 (shown in subsequent FIG. 3) to the outer liner 12. The passage 18 can be sewn into the material as is known in the art. A draw collar 25 holds the ends 23 of the draw string 16, and can be drawn tight about the neck 17, so as to close the tote bag 10 about the neck portion.

Also disposed on the outer surface of the tote bag 10 are one or more resealable openings 13 for accessing the contents (e.g., keys, money, pacifier, not shown) of the closed tote bag 10 from the exterior thereof. The resealable opening 13 can be secured by means of a zipper, Velcro® fastener, snap, or the like.

A non-skid patch 15 is disposed at the lower extremity of the tote bag 10 for preventing sliding motion of the bag 10 with respect to the table or counter, not shown, on which it lies in its open position. Patch 15 can be in the shape of strips, checkered squares, footprints or any other appropriate configuration.

Figure 2:
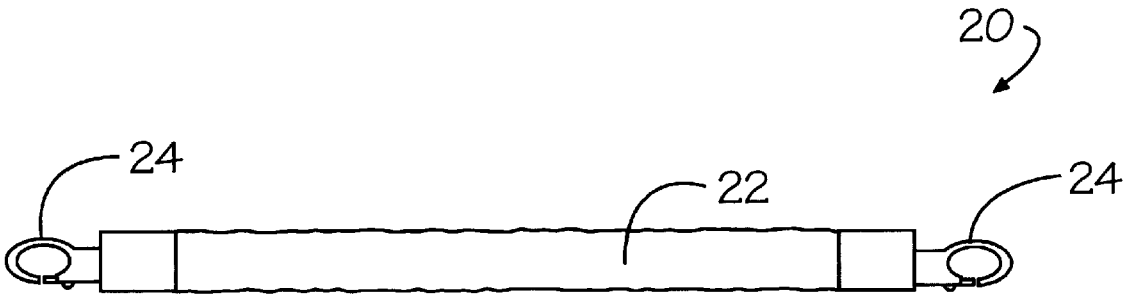
FIG. 2 shows a perspective view of a typical carrying strap that can be attached to the tote bag depicted in FIG. 1.

Referring to FIG. 2, a strap 20 is shown, for attachment to the tote bag 10 of FIG. 1. The body 22 of strap 20 is flexible, made of plastic, leather, or cloth. The strap 20 comprises two spring-loaded hooks 24 that snap into rings 14. The strap 20 is used for carrying the tote bag 10 about the shoulder or waist.

Figure 3:
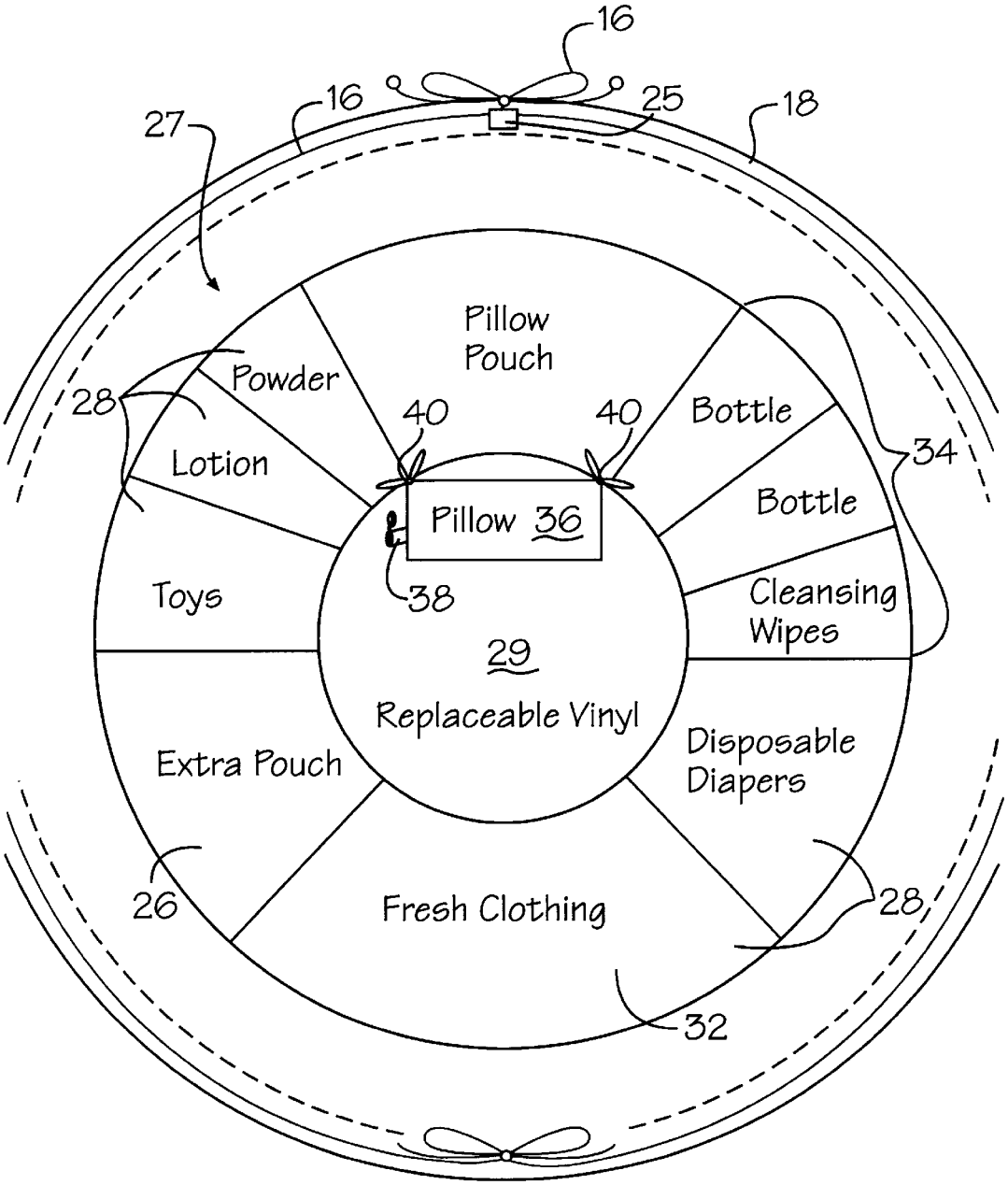
FIG. 3 depicts a schematic, plan view of the inner liner of the tote bag shown in FIG. 1, which inner liner is viewable in the tote bag open position.

Referring to FIG. 3, the inner liner 27 is shown in a plan view. The inner liner 27 comprises a number of compartments 28 disposed in a circle, as illustrated. In the center portion of the circle is a rest area 29 for placing a moist baby to be diapered.

The draw string 16 is illustrated with tote bag in the open position. Note that the draw string 16 runs through the hollow passage 18 created between the inner liner material 27 and the outer liner 12, not shown in this view. The passage 18 is disposed along a peripheral edge thereof, in order to draw the liner 12 into a closed tote bag configuration.

The plurality of pockets or compartments 28 are laid out in a pattern. The pockets are specifically designed to hold individual baby items, such as diapers, powder, lotion, toys, cleansing cloths, towelettes and baby clothing. The compartments 28 are individually shaped and sized to accommodate the particular baby or parent item. Each compartment 28 is stitched or thermally welded into the inner bag lining 27. Specific elongated pockets can hold warm baby bottles, as shown by pockets 34. These elongated pockets 34 are both waterproof and thermally insulated. Wallets and car keys are disposed in a rectangular compartment 26 as befits their shape and size.

All of the compartments have a transparent, plastic window 32 disposed over the compartment of each stored article. The window 32 allows the item to become easily observable and recognized at a glance. The plastic window 32 can form half of the internal compartment 28.

The tote bag 10 easily opens into a substantially flat panoply of articles when the collar 25 releases the draw string 16. All of the items needed by the parent present themselves in a panoramic display view. The pockets 28 are circumferentially disposed about a center portion 29 of the bag interior, as aforementioned. A stiffener, not shown, can be suitably provided to add structure to the tote bag 10, allowing the opened bag 10 to be bowl-shaped, so that the infant is protected from wind, and so that the contents of compartments 28 do not roll or spill out.

The center portion 29 serves as a safe, visible resting place for the baby during changing, and while the parent is busy extracting the needed items from the pockets 28. The center portion 29 is provided with a soft pad for the baby. The pad can be disposed within the liner 27, or it can be made removable. The liner 27 is a waterproof surface. The center pad can be scented, and made removal from the liner for periodic changing. The center portion 29 can also be provided with a built-in pillow 36. The pillow 36 can be removably attached to the liner 27 by strings 40, Velcro® fasteners, or by one or more snap or tie fasteners. The pillow 36 provides a means by which the head or body of the infant can be propped up. Additionally, by removing or flipping the pillow 36 upwardly, the center portion changing area 29 is enlarged to accommodate bigger children. The pillow 36 is generally folded flat, and can be inflated by blow tube 38.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A sanitary baby diaper changing article comprising a substantially circular handy tote bag for carrying sanitary baby items needed to diaper and care for an infant at a remote, unsanitary and unprotected location, said tote bag unfolding to reveal and comprise:

a) a water-proof, substantially circular liner defining a centrally located portion of a tote bag, and having means defining a limited area and resting place for depositing a single infant being cared for inside said tote bag, said limited area and resting place further defining a portion thereof for attaching a pillow for supporting a baby deposited therein;

b) a plurality of easily identifiable pockets arranged radially about said centrally located liner for easy access to items contained in said pockets, as said baby is placed upon said waterproof, substantially circular liner, said pockets being of different sizes and shapes suited for reception of a variety of items appropriate for infant care and diapering, said plurality of easily identifiable pockets including an insulated pocket for carrying a baby bottle, said insulation providing means by which said baby bottle can be maintained at temperature, a water-proof pocket for carrying a soiled diaper and for isolating said soiled diaper from a remainder of said tote bag, a pocket for carrying a fresh diaper for changing baby, and a pillow pocket for carrying a pillow for placement in said limited area and resting place, said pillow being disposed flat within said pillow pocket; and c) closure means around the external periphery of said tote bag.

2. The handy tote bag for carrying baby items needed to diaper and care for an infant at a remote location as recited in claim 1, wherein said insulated pocket is kept warm or cold as required.

3. The handy tote bag for carrying baby items needed to diaper and care for an infant at a remote location as recited in claim 1, wherein at least one of said pockets is a transparent pocket and whereby the contents of said transparent pocket may be readily identified.

4. The handy tote bag for carrying baby items needed to diaper and care for an infant at a remote location as recited in claim 1, wherein said pillow is inflatable, said pillow being removable from said respective pocket and inflated via a blow tube, wherein said pillow can be placed under said infant for comforting said infant in said limited area and resting place.

* * * * *